US005322276A

United States Patent [19]

Hardison, Jr.

[11] Patent Number: 5,322,276

[45] Date of Patent: Jun. 21, 1994

[54] BAT SWING GUIDE

[76] Inventor: George T. Hardison, Jr., Diamond City Rd., Rte. 1, Box 402, Jamesville, N.C. 27846

[21] Appl. No.: 3,528

[22] Filed: Jan. 12, 1993

[51] Int. Cl.[5] ..... A63B 69/40

[52] U.S. Cl. ..... 273/26 R

[58] Field of Search ..... 273/26 R, 191 R, 29 A, 273/191 A, 192

[56] References Cited

U.S. PATENT DOCUMENTS 1,854,392 4/1932 Bambrick ..... 273/191 A
2,985,452 5/1961 Trippet ..... 273/26 R
3,482,838 12/1969 Gibson et al. ..... 273/191 R
3,904,199 9/1975 Burchett ..... 273/26 R
4,886,267 12/1989 Licciardi et al. .
5,029,852 7/1991 Gifillan ..... 273/26 R
5,087,039 2/1992 Leseke ..... 273/26 R

*Primary Examiner*—Theatrice Brown
*Attorney, Agent, or Firm*—Rhodes Coats & Bennett

[57] ABSTRACT

A bat swing guide. The guide includes a vertical support member and an arcuate guide attached at one end to the vertical support member. The arcuate guide is generally semi-circular and may be positioned to accommodate either a righthanded or lefthanded hitter. A pivoting tee is attached to the vertical support member for supporting a ball. An adjustable bat stop is attached to the distal end of the arcuate guide.

26 Claims, 2 Drawing Sheets

BAT SWING GUIDE

BACKGROUND OF THE INVENTION

1. Field of the Invention

The present invention relates generally to baseball training devices and, more particularly, to a guide for training a batter to pattern his swing in a desirable manner.

2. Description of the Prior Art

Hitting a thrown baseball consistently is one of the most difficult skills in all sports. Even the best professional hitters rarely are able to make good ball contact more than one out of three tries. Recently hitters swing mechanics have been studied through slow motion and freeze-frame video tapes. Analysis of these tapes emphasize that the majority of all hitters' weaknesses are related to improper swing mechanics.

The conventional way to make improvements in the batter's swing has been by instructions from a batting coach and batting drills, including patching machines tees, and live pitchers. However, there has been a desire for a training aid not only to facilitate development of proper swing mechanics, but to remediate flaws in the hitter's current mechanics.

Several problems exist in designing a piece of equipment to help develop a variety of hitters. For example, the equipment must adapt to a wide range of hitters' heights and varying hitters' swing arcs. In addition, the device must keep the batter's hands in the same starting position and adjust to low and high pitches. Finally, the device should be versatile enough to be used for both left and right-handed hitters.

There have been several attempts at developing a satisfactory baseball bat swing guide training device. U.S. Pat. No. 2,985,452 (issued to Trippet) and U.S. Pat. No. 5,087,039 (issued to Laseke) disclose baseball bat swing training apparatuses which include a base which sits on the ground with a vertically extending post extending from the base. The baseball bat swing guide is attached to the post and includes a pair of parallel swing guides connected at one end and open at the other end.

The guides, as taught by Trippet and Laseke, force the batter to swing in a generally horizontal plane. However, the guides are limited to the contact zone adjacent to the ball and do not provide any aid in the approach to the contact zone.

U.S. Pat. No. 5,029,853 (issued to Gilfillan) discloses an improved bat swing guide which has a horizontal guide member, an arcuate guide member and a base. The arcuate guide member may be adjusted for the height of the batter and for a left or right-handed batter. The length of the arcuate guide member is measured by an angle of 90 to 180 degrees and the radius varies from 30–45 inches. The horizontal member includes a fixed ball holding means to allow a batter to strike a ball at completion of the guide swing.

While a substantial improvement over earlier bat swing guides, the Gilfillan apparatus includes a simplistic arc which does not restrict common flaws in proper swing mechanics, and promotes a long, slow, looping-style swing. In addition, there is no means to vary position of the ball to simulate different pitches.

Thus, there remains a need for a new and improved bat swing guide which promotes a shorter, more compact stroke and, in addition, provides a means for varying the position of the ball to simulate different pitches.

SUMMARY OF THE INVENTION

The present invention is directed to a bat swing guide which includes a vertical support member and an arcuate guide attached at one end to the vertical support member. The arcuate guide is generally semi-circular and includes a bat load zone, a hook zone, a trigger zone, an A to C pathway, and a contact zone. The arcuate guide may be positioned to accommodate either a righthanded or lefthanded hitter. A pivoting tee is attached to the vertical support member for supporting a ball. An adjustable bat stop is attached to the distal end of the arcuate guide.

The pivoting tee includes a ball support member, a pivotally mounted support arm attached to one end of the ball support member, and a bracket attached to the vertical support member. The ball support member includes a flexible tube for supporting a ball.

The means for positioning the arcuate guide includes a horizontal trough attached to the upper end of the vertical support member for supporting the arcuate guide, a perpendicular slot across the end of the arcuate guide adjacent to the trough, a L-shaped member attached to one end of the trough for receiving the open end of the arcuate guide, and locking means for compressing the L-shaped member within the arcuate guide to maintain the arcuate guide in a selected position.

Accordingly, one aspect of the present invention is to provide a bat swing guide. The guide includes: (a) a vertical support member; (b) an arcuate guide attached at one end to the vertical support member; and (c) a pivoting tee attached to the vertical support member for supporting a ball, the tee being positionable adjacent to the arcuate guide.

Another aspect of the present invention is to provide a bat swing guide. The guide includes: (a) a vertical support member; and (b) an arcuate guide attached at one end to the vertical support member, the arcuate guide being generally semi-circular and including a bat load zone, a hook zone, a trigger zone, an A to C pathway, and a contact zone.

Still another aspect of the present invention is to provide a bat swing guide. The guide includes: (a) a vertical support member; (b) an arcuate guide attached at one end to the vertical support member, the arcuate guide being generally semi-circular and including a bat load zone, a hook zone, a trigger zone, an A to C pathway, and a contact zone; and (c) a pivoting tee attached to the vertical support member for supporting a ball, the tee being positionable adjacent to the arcuate guide.

These and other aspects of the present invention will become apparent to those skilled in the art after a reading of the following description of the preferred embodiment when considered with the drawings.

DESCRIPTION OF THE PREFERRED EMBODIMENTS

Figure 2:
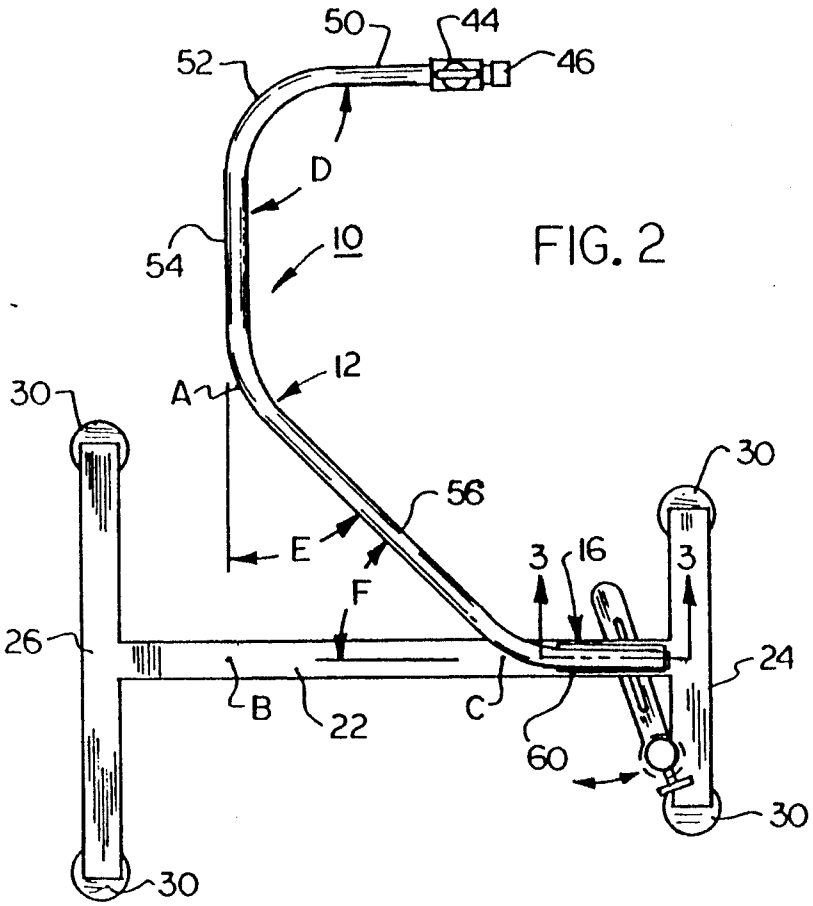
FIG. 2 is a top plan view of the bat swing guide shown in FIG. 1.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
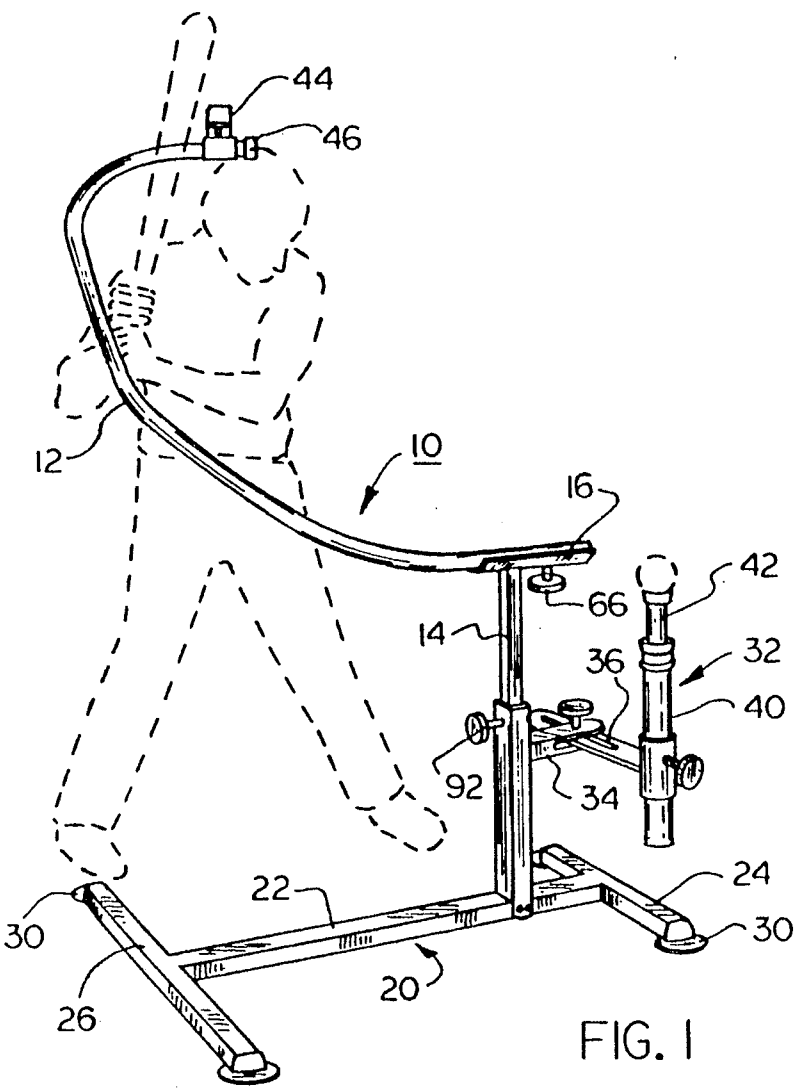
FIG. 1 is a perspective view of a bat swing guide constructed according to the present invention, showing a right-handed hitter and ball in phantom.

Referring now to the drawings in general and FIG. 1 in particular, it will be understood that the illustrations are for the purpose of describing a preferred embodiment of the invention and are not intended to limit the invention thereto. As best seen in FIG. 1, a bat swing guide, generally designated 10, is shown constructed according to the present invention. The bat swing guide 10 includes an arcuate guide 12, a vertical support member 14, a locking support 16 for attaching the arcuate guide to the vertical support member 14 and a base generally designated 20.

Base 20 includes a longitudinal member 22 having a front lateral support 24 and a rear lateral support 26. The outward ends of the front and rear lateral supports 24,26 include a plurality of support feet 30.

A pivoting tee assembly 32 is attached to vertical support member 14 by bracket 34 and adjustable arm 36. Pivoting tee 32 includes a vertical support member 40 attached at one end to arm 36 and having a flexible ball holder 42 at the other end.

In the preferred embodiment, arcuate guide 12 also includes an adjustable stop 44. A protective cover 46 prevents the hitter's head from striking the open end of the arcuate guide 12.

As best seen in FIG. 2, arcuate guide 12 includes five distinct areas. These are the bat load zone 50, hook 52, trigger zone 54, A–C pathway 56 and contact zone 60.

The bat load zone 50 is the initial starting position of the bat against the inner portion of the near vertical track. One major flaw regarding this area in a hitter's swing is "wrapping" the bat, or pointing the bat head back toward the pitcher. The further the bat head is from the contact zone, the longer the swing is, so the hitter has to start his bat into motion sooner. Pitchers are taught to disrupt the hitter's swing rhythm by changing speed and location. Pitches such as change-ups, curve balls, sliders are intended to intentionally deceive the hitter and fool him into taking a weak cut at a ball that is either changing planes as it reaches the hitter (curves or sliders) or changing speed (change-ups) or a combination of both speed and location. The earlier a hitter has to start a swing into motion just to get around on the fastball makes him more susceptible to being fooled and having to stop a swing already put into motion. The result is usually a weak ground ball or popup. The bat head should cock or "load" slightly when the hands trigger the swing, i.e. a slight push away from the pitcher prior to the hands starting down into the ball, but too much load causes wrapping the bat head, creating a longer swing. Adjustable stop 44 on the bat load zone 50 regulates this loading of the bat head. The stop can be used as immediate feedback to the hitter as too much load or it can be used to teach this loading action in hitters who don't cock the bat head at all. The absence of a bat load zone 50 has been found to cause considerable anxiety with the hitter worrying about even getting started on top of the track and not accidentally underneath it.

The hook section 52 has the specific purpose of keeping the bat head from flying out away from the hitter's head and looping at the top of the swing. Leading hitting authorities call this looping action behind the hitter "casting". By casting the bat head at the top, a hitter lengthens the radius between the bat head and the longitudinal axis of the body, thus lengthening the swing. As this radius increases, the angular velocity of the bat head decreases resulting in a slow, lagging bat head through the contact zone 60. As the hands start downward into the swing, the bat head is caught by the inside portion of the hook 52 and prevents the bat head from casting, keeping the bat head closer to the longitudinal axis of he body, resulting in a quicker, shorter path to the ball. Consequently, with a shorter, more compact, swing, the length of time it takes to move the bat head from the bat load zone 50 to the contact zone 60 decreases, thus giving a hitter more time to study the pitch before making a split-second decision to swing. Using a short, compact stroke, the hitter is less likely to be fooled by off speed and breaking pitcher than compared with a longer, slower swing.

The trigger zone 54 gives the hitter feedback of the "hand trigger" that initiates the swing. Practically all hitting coaches agree that before, making any forward movement beginning the swing, it should be preceded by some type of rotary motion away from the pitcher. This can be noted in a rotary movement away from the pitcher of the front knee, hip or shoulder. This cocking action of the front side moves the hands to the launch position, i.e. bottom hand on bat at the top of the strike zone just off the back shoulder, away from the pitcher. This movement is not apparent in most inexperienced hitters. By positioning the hitter inside the track with the hands 2–4 inches from the trigger zone 54, the hitter can be coached into moving the hands back until they or the bat contacts the track, receiving immediate feedback about the cocking of the hands. The cocking of the hands should slightly load the bat head until it contacts the adjustable stop 44 in the bat load zone 50. The trigger bar 54 not only facilitates cocking of the hands in hitters, but regulates the amount of cock in the same manner for hitters with "noisy" hands, i.e. too much hand movement. Another function of the trigger zone 54 is to keep the bat head above the hands as the bottom hand starts the pulling action down into the swing. This eliminates the bat head from looping in the lower part of the swing plane resulting in an uppercut. Major league coaches preach keeping the bat head above the hands on entry into the ball on pitches mid-thigh high and above.

Lazy fly balls are the easiest defensive plays in baseball and should be avoided in trying to develop a swing unless a hitter has the ability to consistently hit the ball out of the park.

The A to C pathway is designed to train hitters to move from the launch position of Point A directly to Point C at the contact zone 60. A hitter thus drives his hands directly from Point A to Point C, avoiding Point B (all areas below A to C pathway) entirely. Carrying the hands into the B area results in a long looping swing that is slower. By having the trigger zone 54 for hitters to bump, their hands can be trained with lead-up drills to move through this pathway resulting in a short, compact stroke that is quicker, generating more angular velocity due to decreased radius between the bat head and the longitudinal axis of the body.

The contact zone 60 is where the top hand starts to accelerate the bat head through the ball. In physics terms, the two hands form a mechanical couple, i.e. two forces in opposite directions about a fixed axis causing rotation. In this case, the fixed point is a point between the hands in the "palm-up, palm-down" position. A baseball bat is a simple machine classified as a lever. Used with the mechanical coupling effect of the hands, a baseball bat being swung is a third class lever favoring speed as a result of the position of the axis and forces applied. As the hitter gets the push/pull action of the hands, tremendous velocity is generated at the opposite end of the lever, i.e. the bat head. Since this is the area in the swing in which the bat head velocity is greatest, this is the ideal location to make contact with the ball. The contact zone 60 starts to flatten out the downward action of the hands through the A to C pathway to flatten the plane of the swing just prior to contact.

The natural tendency after the bat momentarily flattens in the contact zone 60 is for the hitter to continue in a circular pattern. In the present invention, the length of the contact zone 60 is intentionally kept short, so smaller hitters pulling across the ball earlier will not be forced to follow through unnaturally. In many tee settings, the ball will be contacted out in front of contact zone 60.

Figure 3:
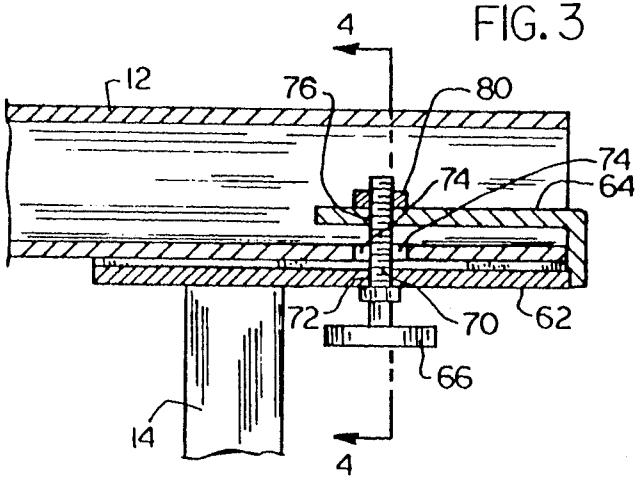
FIG. 3 is a cross-sectional view of the arcuate locking means of the bat swing guide shown in FIG. 2 taken along lines 3—3

As best seen in FIG. 3, there is shown a crosssectional view of the arcuate locking means of the bat swing guide 10 shown in FIG. 2 and taken along lines 3—3. The distal portion of lower support cross section 62 is attached to a cantilever rod 64. Knob 66 is attached to rod 70 which extends through an aperture 72 in the lower support crosssection 62 and through milled slot 74 and arcuate guide 12. An aperture 76 passes through the end of cantilever rod 64 and adjacent to a threaded nut 80 of the opposite side of the cantilever rod. In operation, as knob 60 is turned in a clockwise fashion, nut 80 is tightened against cantilever rod 64 causing the rod to bend downward and contact the inner surface of arcuate guide 12. This compresses arcuate guide 12 between cantilever rod 64 in lower support cross-section 62. Loosening knob 66 allows arcuate guide 12 to be rotated between position for left-handed an right-handed players.

Figure 4:
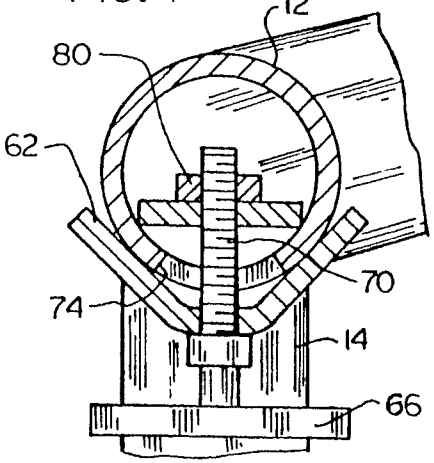
FIG. 4 is a cross-sectional view of the arcuate locking means of the ball swing guide shown in FIG. 3, taken along lines 4—4; an FIG. 5 is a front view of the bat swing guide shown in FIG. 1.

The locking arrangement can better be seen in FIG. 4 which is a cross-sectional view of the arcuate locking means of the ball swing guide as shown in FIG. 3 taken along lines 4—4.

Figure 5:
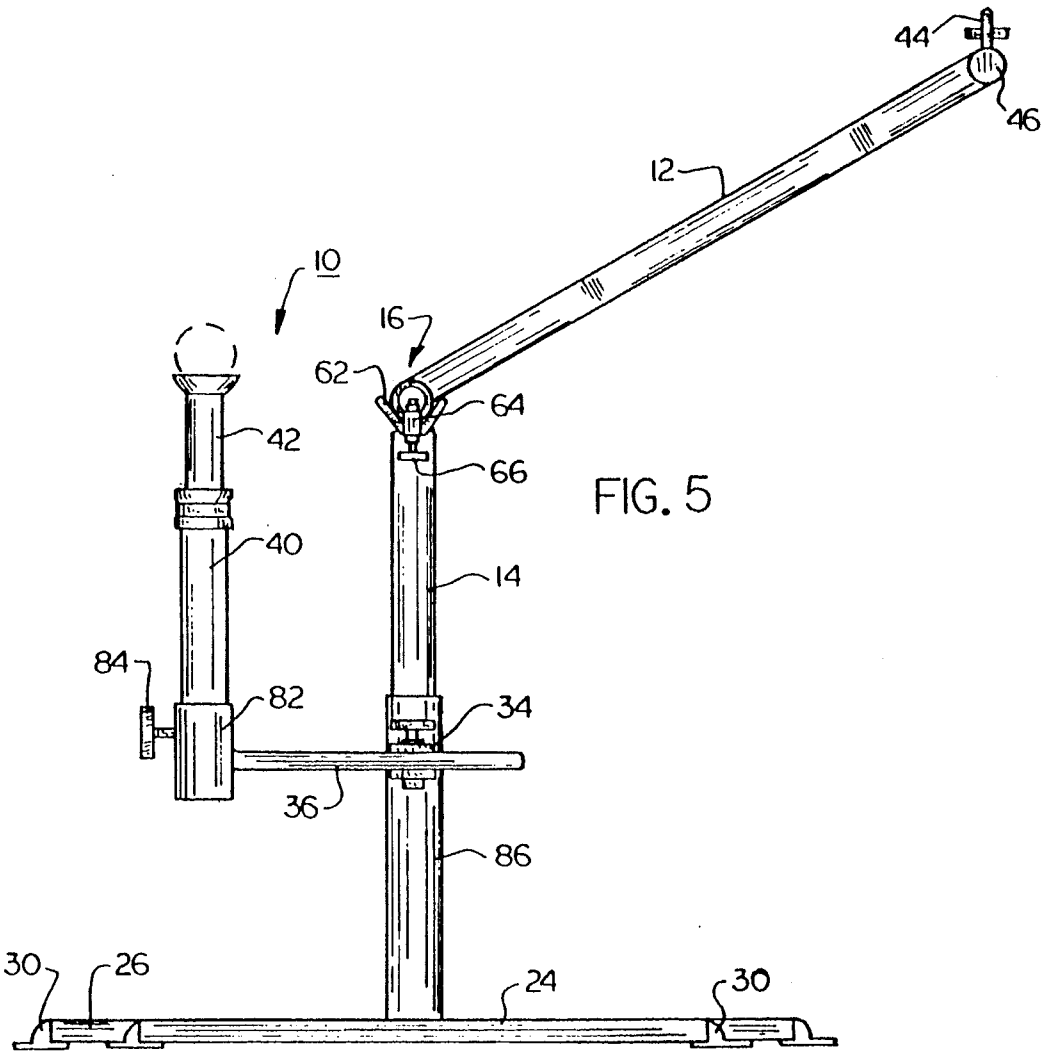

Finally FIG. 5 shows a front view of the bat swing guide 10 shown in FIG. 1. As can be seen, pivoting tee assembly 32 preferably includes a adjustable collar 82 connected to the end of support arm 36 opposite bracket 34 and a locking means 84 for allowing vertical member 40 to be positioned in various vertical heights. Similarly, vertical member 14 may include an upper support section 86 and a lower support section 90 and a locking means 92 enabling the hitter to adjust the vertical height of the arcuate guide 12.

The pivoting tee 32 of the present invention teaches hitters in what part of their swing they should hit certain pitches. Many coaches instruct hitters to pull the inside pitch, to hit the ball in the middle of the plate back up the middle, and to hit an outside pitch to the opposite field. This is sound philosophy, however, very few actually realize where these pitches are contacted in the swing. The pivoting tee allows the plate to be divided into thirds and, depending on where the ball is located over these three zones, determines which direction a ball should be hit and at what point it should be contacted.

Balls on the outside third of the plate should be hit to the opposite field. In order to do this, the hands have to be ahead of the bat head so the angle of incidence formed by the incoming ball relative to the position of the approaching bat head directs the ball to the opposite field. In order to do this, balls are hit earlier in the swing plane. Normally, hitting instructors encourage hitting the outside third pitch over the far middle corner of the plate. This can vary with the size of hitter, i.e. further forward the shorter the radius of the smaller hitter, or depending on the hitter's initial alignment to the plate. Balls over the middle third of the plate should be hit up the middle. To achieve this, the ball is hit farther forward in the swing plane so the hands are even with the bat head and the angle of the incidence between the bat and ball directs it back through the middle of the playing field. This pitch is generally contacted slightly forward of he plate (0–4 inches), dependent on the size of the hitter and alignment to the plate. The pitch on the inside third of the plate must be hit well out in front of the plate if the hitter is to get the bat head on the ball and avoid being jammed on the handle. It is imperative for the hitter to be able to get the bat head out quickly in front of the hands and pull the pitch without being jammed.

The pivoting tee 32 is fully adjustable to contact the ball in all three zones in the correct part of the swing plane, regardless of the hitter's size or alignment to the plate. The tee can pivot about 300° allowing the same features on both sides of the plate. The tee has a separate height adjustment since the ball must be contacted below the track on low pitches and nearer the same height as the track on pitches nearing waist high.

In the initial stages of developing a shorter, more compact stroke, the hitter is advised to allow the bat, or other training stick, to ride along the swing guide. When used properly, the design of the arc will prohibit the bathead from moving into areas where common hitting flaws occur. The present invention functions as a motor learning device. Practice swings, even without using the pivoting tee, train nerves and muscles by forcing them into mechanically correct "neuromuscular pathways." This repetitive action over time develops new swing patterns or habits. As a hitter's stroke develops, the bathead may leave the guide and pass even more directly to the ball, resulting in an even shorter stroke. At this point, the guide now serves as a restrictive device setting an outer or lower limit prohibiting the bathead from going into B area. Since this training device develops new neuromuscular pathways, it can be used to train proper mechanics in players attempting to become switch-hitters.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A bat swing guide, said guide comprising:

(a) a vertical support member;

(b) an arcuate guide attached at one end to said vertical support member; and (c) a pivoting tee attached to said vertical support member for supporting a ball, said tee being adjustable relative to and adjacent to said arcuate guide, wherein said pivoting tee includes a ball support member, a support arm attached to one end of said ball support member, and a bracket attached to said vertical support member.

2. The guide according to claim 1, further including an adjustable bat stop attached to the distal end of said arcuate guide.

3. The guide according to claim 1, wherein the other end of said vertical support member is attached to a base.

4. The guide according to claim 3, wherein said base includes a longitudinal member and a pair of lateral members attached to each end of said longitudinal member.

5. The guide according to claim 1, wherein said vertical support member includes a pair of telescopically mounted tubes and a locking means whereby the height of said vertical support member may be adjusted.

6. The guide according to claim 1, wherein the other end of said ball support member includes a flexible tube for supporting a ball.

7. The guide according to claim 1, wherein said support arm is pivotally mounted to said bracket.

8. The guide according to claim 1, wherein said support arm includes a slotted portion which is slidably mounted to said bracket to permit lateral adjustment of said ball support member with respect to said vertical support member.

9. The guide according to claim 1, further including means for adjusting the height of said ball support member.

10. The guide according to claim 1, further including means for positioning said arcuate guide to accommodate either a righthanded or lefthanded hitter.

11. The guide according to claim 10, wherein said means for positioning said arcuate guide includes a horizontal trough attached to the upper end of said vertical support member for supporting said arcuate guide, a slot perpendicular to the end of said arcuate guide adjacent to said trough, a L-shaped member attached to one end of said trough for receiving the open end of said arcuate guide, and locking means for compressing said L-shaped member within said arcuate guide to maintain said arcuate guide in a selected position.

12. A bat swing guide, said guide comprising:

(a) a vertical support member;

(b) an arcuate guide attached at one end to said vertical support member, said arcuate guide being generally semi-circular and including a bat load zone, a hook zone, a trigger zone, an A to C pathway, and a contact zone; and (c) a pivoting tee attached to said vertical support member for supporting a ball, said tee being adjustable relative to and adjacent to said arcuate guide, wherein said pivoting tee includes a ball support member, a support arm attached to one end of said ball support member, and a bracket attached to said vertical support member.

13. The guide according to claim 12, further including an adjustable bat stop attached to the distal end of said arcuate guide.

14. The guide according to claim 12, wherein the other end of said vertical support member is attached to a base.

15. The guide according to claim 14, wherein said base includes a longitudinal member and a pair of lateral members attached to each end of said longitudinal member.

16. The guide according to claim 12, wherein said vertical support member includes a pair of telescopically mounted tubes and a locking means whereby the height of said vertical support member may be adjusted.

17. The guide according to claim 12, wherein the other end of said ball support member includes a flexible tube for supporting a ball.

18. The guide according to claim 12, wherein said support arm is pivotally mounted to said bracket.

19. The guide according to claim 12, wherein said support arm includes a slotted portion which is slidably mounted to said bracket to permit lateral adjustment of said ball support member with respect to said vertical support member.

20. The guide according to claim 12, further including means for adjusting the height of said ball support member.

21. The guide according to claim 12, further including means for positioning said arcuate guide to accommodate either a righthanded or lefthanded hitter.

22. The guide according to claim 21, wherein said means for positioning said arcuate guide includes a horizontal trough attached to the upper end of said vertical support member for supporting said arcuate guide, a slot perpendicular to the end of said arcuate guide adjacent to said trough, a L-shaped member attached to one end of said trough for receiving the open end of said arcuate guide, and locking means for compressing said L-shaped member within said arcuate guide to maintain said arcuate guide in a selected position.

23. The guide according to claim 12, wherein said bat load zone is generally perpendicular to said trigger zone.

24. The guide according to claim 23, wherein said trigger zone is generally perpendicular to said contact zone.

25. The guide according to claim 24, wherein said A to C pathway forms a 45 degree angle between said trigger bar and said contact zone.

26. The guide according to claim 12, wherein said bat zone is generally parallel to said contact zone.

* * * * *